US009422773B2

(12) United States Patent
Karunakaran et al.

(10) Patent No.: US 9,422,773 B2
(45) Date of Patent: Aug. 23, 2016

(54) RELATING TO BUOYANCY-SUPPORTED RISERS

(71) Applicant: Subsea 7 Limited, Sutton (GB)

(72) Inventors: Daniel Karunakaran, Tananger (NO); Frederico Nicoletti De Fraga, Niteroi (BR); Chunqun Ji, Houston, TX (US); Chunfa Wu, Houston, TX (US); Yun Ding, Sugar Land, TX (US)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 14/436,065

(22) PCT Filed: Oct. 7, 2013

(86) PCT No.: PCT/GB2013/052600

§ 371 (c)(1),
(2) Date: Apr. 15, 2015

(87) PCT Pub. No.: WO2014/060717

PCT Pub. Date: Apr. 24, 2014

(65) Prior Publication Data

US 2015/0247366 A1 Sep. 3, 2015

(30) Foreign Application Priority Data

Oct. 15, 2012 (BR) ..... 102012026413
Oct. 15, 2012 (GB) ..... 1218468.5

(51) Int. Cl.
*E21B 17/01* (2006.01)
*B63B 22/02* (2006.01)
(Continued)

(52) U.S. Cl.
CPC ..... *E21B 17/012* (2013.01); *B63B 22/023* (2013.01); *B63B 22/04* (2013.01); *B63B 22/20* (2013.01); *E21B 17/015* (2013.01)

(58) Field of Classification Search
CPC ..... E21B 17/01; B63B 22/04; B63B 22/20
USPC ..... 441/23, 28
See application file for complete search history.

(56) References Cited

U.S. PATENT DOCUMENTS 1,532,246 A * 4/1925 Kottke ..... A47J 45/10 294/33
2,273,087 A * 2/1942 Burrell ..... B21C 47/34 242/531.1
2,475,788 A * 7/1949 Kidder ..... G08B 17/06 374/113

(Continued)

FOREIGN PATENT DOCUMENTS

CN 102418480 4/2012
GB 1 532 246 11/1978

(Continued)

*Primary Examiner* — Lars A Olson
*Assistant Examiner* — Jovon Hayes
(74) *Attorney, Agent, or Firm* — Levy & Grandinetti

(57) ABSTRACT

A subsea riser support buoy is disclosed having a riser support member and a jumper support member that extend generally parallel to each other and that define a lengthwise direction extending between them across the buoy. Pontoons extend lengthwise beyond the riser support member and the jumper support member to provide attachment points for connecting tethers to the buoy. In this way, the attachment points are spaced more widely than lengthwise extremities of the riser support member and the jumper support member, beneficially altering the dynamic behavior of the buoy and especially its pitch characteristics.

13 Claims, 6 Drawing Sheets

(51) Int. Cl.
*B63B 22/04* (2006.01)
*B63B 22/20* (2006.01)

(56) References Cited

U.S. PATENT DOCUMENTS 5,480,264 A * 1/1996 Hunter ..... E21B 17/015 405/169
5,639,187 A * 6/1997 Mungall ..... E21B 17/015 166/350
6,447,208 B1 * 9/2002 Huang ..... B63B 21/502 114/265
6,780,072 B1 * 8/2004 de Almeida ..... B63B 21/50 441/4
8,893,802 B2 * 11/2014 Luppi ..... B63B 21/507 166/345
9,121,228 B2 * 9/2015 Prescott ..... E21B 17/01
2004/0161984 A1 8/2004 Lima de Almeida et al.
2005/0158126 A1 * 7/2005 Luppi ..... B63B 21/508 405/224.2
2007/0056742 A1 * 3/2007 Hatton ..... E21B 17/015 166/367
2009/0185869 A1 * 7/2009 Leverette ..... B63B 21/502 405/223.1
2009/0235856 A1 * 9/2009 Mansour ..... B63B 21/50 114/265
2009/0279958 A1 * 11/2009 Heidari ..... B63B 35/44 405/223.1
2013/0000541 A1 * 1/2013 Rijken ..... B63B 21/502 114/265
2015/0247366 A1 * 9/2015 Karunakaran ..... B63B 22/023 441/23

FOREIGN PATENT DOCUMENTS

GB 2 273 087 6/1994
GB 2 475 788 6/2011
WO WO 96/11134 4/1996
WO WO 9611134 A1 * 4/1996 ..... B63B 22/021
WO WO 03/093627 11/2003
WO WO 03/097990 11/2003
WO WO 03093627 A1 * 11/2003 ..... B63B 21/508
WO WO 03097990 A1 * 11/2003 ..... B63B 21/508
WO WO 2011/083268 7/2011
WO WO 2012/001406 1/2012
WO WO 2012001406 A2 * 1/2012 ..... B63B 21/00

* cited by examiner

RELATING TO BUOYANCY-SUPPORTED RISERS

This invention relates to subsea riser systems used to transport well fluids from the seabed to a surface installation such as an FPSO vessel or a platform. The invention relates particularly to buoyancy-supported riser ('BSR') systems.

A BSR system is an example of a hybrid riser system. Such systems are characterised by rigid riser pipes that extend upwardly from the seabed to a subsea support and by flexible jumper pipes that extend from the subsea support to the surface. The jumper pipes add compliancy that decouples the riser pipes from surface movement induced by waves and tides. The riser pipes experience less stress and fatigue as a result.

In a BSR system, the subsea support is a riser support buoy held in mid-water, tethered to a seabed anchorage under tension. The buoy is held at a depth below the influence of likely wave action but shallow enough to permit diver access and to minimise the possibility of collapse under hydrostatic pressure. A depth of 250 m is typical for this purpose but this may vary according to the sea conditions expected at a particular location, for example between 100 m and 300 m.

Riser pipes, typically of lined and coated steel, hang from the buoy. The riser pipes may extend substantially vertically along a riser tower or may splay away from one end of the buoy as steel catenary risers or 'SCRs'. SCRs are a non-limiting example: other types of pipe are possible for the riser pipes. Jumper pipes hang as catenaries from an opposite end of the buoy to extend to an FPSO or other surface installation moored above, and offset horizontally from, the buoy.

Umbilicals and other pipes follow the general paths of the riser pipes and the jumper pipes to carry power, control data and other fluids.

In deep water, a surface installation such as an FPSO will usually have spread moorings. Spread moorings typically comprise four sets of mooring lines (each set being of say four to six mooring lines) with the sets radiating with angular spacing from the FPSO to anchors such as suction piles or torpedo piles embedded in the seabed.

In a spread-moored arrangement, a riser system is typically accommodated between neighbouring sets of mooring lines of the FPSO. Space may be limited such that in extreme conditions, there is a potential for interference or clashing between the mooring lines of the FPSO and the riser support buoy and/or the riser pipes.

It is necessary to ensure that BSR systems have enough stability to resist excessive movement of the riser support buoy in extreme conditions. The tension in the tethers created by buoyancy is a stabilising factor; so too are the horizontally-opposed forces applied to the buoy by the riser pipes and to a lesser extent by the jumper pipes. It may also be possible to apply additional stabilising balancing forces to a buoy, for example by means of guy lines extending to the seabed or to the FPSO or by interconnections between neighbouring buoys. However, such additional measures increase cost and there may be insufficient space to use them without introducing a risk of clashing.

Conventional moorings for subsea buoys fall into two categories, namely slack wire moorings and taut wire moorings. In slack wire moorings, the mooring lines are in a catenary shape such as the CALM (catenary anchor leg mooring) buoy shown in WO 96/11134. In taut wire moorings, tensioned wires may be substantially vertical as shown in GB 1532246 or opposed at substantial angles to the vertical as shown in GB 2273087.

U.S. Pat. Nos. 5,639,187, 6,780,072 and WO 2012/001406 disclose BSR systems having moorings comprising substantially vertical taut wire tethers. In each case, the riser support buoy is generally rectangular in plan view, defining 90° corners, and the tethers are attached to outer side walls of the buoy near those corners of the buoy. Generally the tethers are located at the sides of the buoy to be as far as possible from the riser pipes and the jumper pipes that hang from opposite ends of the buoy, in order to avoid clashing with those pipes.

For example, the buoy disclosed in WO 2012/001406 comprises a riser support member and a jumper support member defining the length of the buoy between them. The riser support member and the jumper support member extend in parallel between, and lie orthogonally with respect to, parallel side members. The buoy is moored by four pairs of tethers, each comprising a top chain connected to a central length of spiral strand wire. Two of those pairs of tethers are attached to each side member, with each pair being attached near a respective end of the side member. The tethers are all attached to the side members inboard of the length of the buoy, as measured by the length of the side members or between the lengthwise extremities of the riser support member and the jumper support member.

To meet operational requirements, it is important that a riser support buoy is maintained at an appropriate depth and at an appropriate location and orientation in the water. It is also important that the tethers each bear an appropriate share of the buoyant load, even though the tethers may extend differently and unpredictably in use. For these reasons, it is necessary to have a system for tension adjustment to balance loads in the tethers. WO 2012/001406, for example, discloses top connectors mounted on the side members that can serve as tensioning devices for respective tethers. The tensioning devices comprise chain stops functioning as ratchet mechanisms that engage with links of the top chains of the tethers. Each top connector is mounted on a respective hang-off porch that is cantilevered from an outer wall of the associated side member of the buoy.

It should be noted that the tethers in a BSR system will usually be slightly off vertical even in the absence of water currents, typically leaning toward the riser pipes which apply a greater horizontal pull to the buoy than the jumper pipes. Consequently, references in this specification to tethers being 'substantially vertical' are intended to cover instances where the tethers would assume a vertical orientation if the buoy was not subject to horizontal force components as from water currents or from the loads of jumper pipes and riser pipes. References to 'substantially vertical' are not intended to exclude instances where the tethers are off vertical merely as a consequence of such horizontal force components acting on the buoy, other than as may be imparted by opposing tethers that are themselves substantially off vertical as in GB 2273087.

Slack wire moorings and taut wire moorings at a substantial angle to the vertical are not appropriate for BSR applications. Excursion of the buoy has to be limited to limit pipeline fatigue, which rules out slack wire moorings. Also, as noted above, the riser support buoy and the pipes that it supports are located in a congested space between FPSO moorings, pipelines and umbilicals. Consequently, the footprint of the BSR mooring system has to be as small as possible, with the tethers adopting a minimal angle to the vertical so that the foundations take mainly vertical loads. However, this configuration is less efficient than taut angled moorings as disclosed in GB 2273087, as it offers less stability to dynamic solicitations caused by sea motion.

WO 03/093627 and WO 03/097990 disclose buoys that support flexible risers. The buoys are anchored by substantially vertical taut wire tethers. Stability and excursion issues are addressed by additional mooring lines arranged as catenaries. This catenary arrangement is expensive as it involves more mooring lines and it cannot fit into a congested subsea space. Similar problems afflict U.S. Pat. No. 5,480,264, which uses two or more taut mooring lines, one extending substantially vertically straight below the buoy and the other(s) being at a substantial angle to the vertical to reduce horizontal excursion.

CN 102418480 discloses a riser support device comprising a circular riser support buoy with angularly-spaced cantilever structures extending radially in plan view to support tethers that are outboard of the plan footprint of the buoy. Specifically, the buoy has a 'starfish' structure in which a circular central body is connected to three rectangular-section cantilever buoys at included angles of 120 degrees.

CN 102418480 is not concerned with stability, not least because a top-tensioned riser as used in CN 102418480 does not experience lateral loads applied by catenary risers. Instead, the purpose of the cantilever buoys in CN 102418480 is to achieve neutral buoyancy in different phases of the life of the riser system, during which the overall load on the buoy varies. For example, less buoyancy is needed during installation and more buoyancy is required when the risers are suspended from the buoy and full of oil. So, the length of the cantilever buoys can be varied to change their volume and hence to adjust their buoyancy.

As will be appreciated from the exemplary BSR system shown in FIG. 1 of the accompanying drawings, the relative orientations of an FPSO and a riser support buoy means that roll of the FPSO tends to excite pitching motion of the buoy linked to the FPSO via jumper pipes. In this respect, pitch of the buoy means rotation around a transverse, widthwise axis parallel to the riser support member and the jumper support member, as opposed to roll of the buoy which would be rotation around an orthogonal axis parallel to the side members. The FPSO rolls about a longitudinal axis extending along its hull, which axis is orthogonal to a longitudinal axis of the buoy extending in the general flow direction of fluids through the jumper pipes.

To avoid mechanical resonance effects, the riser support buoy is designed to have a natural pitch period that is substantially different to (generally shorter than) the natural roll period of the FPSO. For example, as the natural roll period of an FPSO is typically between 11 and 13 seconds and most commonly between 11.5 and 12.5 seconds, the dimensions of the buoy may be calculated such that its natural pitch period is between 7 and 9 seconds and typically between 8 and 8.5 seconds.

If the number of suspended riser pipes increases and/or a BSR system is used in a greater depth of water so that the riser pipes must be longer, the riser support buoy must support a greater suspended mass. In that case, the dimensions of the buoy must be increased to provide the additional buoyancy necessary to support the additional mass.

For example, WO 2011/083268 discloses a riser support buoy that is generally U-shaped in plan view. Side members that are buoyant along their full length extend longitudinally far beyond an outboard edge of the riser support member at which loads are applied to the buoy by risers hanging from the buoy. This longitudinal offset of the side members shifts the centre of buoyancy toward the riser end of the buoy where the weight loads are greatest. The buoyant side members extend longitudinally almost as far beyond tether attachment points on the outside of the side members near the outboard edge of the riser support member.

Increasing the apparent mass of a riser support buoy lengthens its natural pitch period when tethers are connected to each end of the buoy. This necessitates using a greater number of tethers at each end of the buoy or using bigger tethers in order to keep the natural pitch period of the buoy below the natural roll period of the FPSO. However, increasing the size and/or the number of tethers may lead to greater problems in balancing the tensile loads in the tethers; designers may even encounter fabrication limits on tether size.

It is against this background that the present invention has been devised.

The invention resides in a subsea riser support buoy comprising: a positively buoyant riser support member and a positively buoyant jumper support member that extend generally parallel to each other and that define a lengthwise direction extending between them across the buoy; side members that extend in the lengthwise direction at ends of the riser support member and the jumper support member to join the riser support member and the jumper support member; and pontoons of negative or neutral buoyancy that extend lengthwise beyond the positive buoyancy of the riser support member and the jumper support member, the pontoons comprising attachment points for connecting tethers to the buoy.

The side members may also be positively buoyant, in which case the pontoons preferably extend lengthwise beyond the positive buoyancy of the side members.

The negative or neutral buoyancy in the pontoons is constant or they are not buoyant at all. The pontoons increase the spacing between tethers to increase the lever arm between the tethers with a minimal increase in the overall mass of the riser support buoy. The pontoons may, for example, extend the overall length of the buoy by 20% to 50% up to the attachment points, and preferably by 30% to 40%, relative to the length of the buoy across the riser support member and the jumper support member.

In summary, the invention solves the problem of limiting the natural pitch period of the riser support buoy while minimising the number and size of the tethers. The invention achieves this by adding extended pontoons suitably located at the corners of the buoy and by relocating top connectors to these pontoons, to which the tethers will be connected upon installation. The extended pontoons increase the rotational moment of the buoy without adding apparent mass to the buoy to the same extent. Consequently, the same number of tethers and similar sizes of tethers can be used as for a buoy of smaller overall dimension.

The pontoons suitably also extend in a widthwise direction beyond the side members. The pontoons may, for example, extend the overall width of the buoy by 5% to 20% up to the attachment points, and preferably by 10% to 15%, relative to the width of the buoy across the side members.

Within the inventive concept, the invention may be defined in alternative terms as a subsea riser support buoy comprising: a positively buoyant riser support member and a positively buoyant jumper support member that define a lengthwise direction extending between them across the buoy; and extended pontoons of negative or neutral buoyancy arranged to connect tethers to the buoy at respective attachment points that are spaced further apart lengthwise than lengthwise extremities of the riser support member and the jumper support member.

Correspondingly, the invention may be expressed as a method of altering the dynamic behaviour of a subsea riser support buoy that comprises a positively-buoyant riser support member and a positively-buoyant jumper support member defining a lengthwise direction extending between them across the buoy, the method comprising providing pontoons of negative or neutral buoyancy to space tether attachment points further apart lengthwise than the positive buoyancy of the riser support member and the jumper support member.

The inventive concept extends to a seabed-to-surface riser system comprising a subsea riser support buoy of the invention and tethers connected to the attachment points of the buoy and extending toward the seabed.

As the tethers are no longer connected at the sides of the riser support buoy and so are closer to the riser pipes and jumper pipes hanging from the ends of the buoy, the extended pontoons of the invention could increase the risk of clashing between the tethers and the riser pipes and jumper pipes. The length and the orientation of the extended pontoons relative to the members defining the underlying rectangular shape of the buoy must be calculated to avoid clashing.

Each pontoon is suitably angled in plan view relative to a side member from which the pontoon extends beyond the lengthwise extremity of an adjacent riser support member or jumper support member. The angle between the longitudinal axis of the pontoon and the longitudinal axis of the side member should preferably be from 0° to 45° and more preferably should be greater than 20° to avoid clashing with the riser pipes or the jumper pipes. Most preferably that angle will be between 25° and 35°. However, it is further preferred that the angle between the longitudinal axes of the pontoon and the side member is not greater than 45°, as otherwise the extended pontoon would have less or no effect on the natural pitch period of the riser support buoy.

The length of each pontoon along its longitudinal axis extending beyond the members to which it is attached must be sufficient to increase the rotational moment of the riser support buoy to a desired extent. However, the pontoons must not be too long as otherwise they may become too heavy and so disadvantageously increase the apparent mass of the buoy. Typically the length of each pontoon along its longitudinal axis is between 3 m and 8 m and preferably between 4 m and 7 m, in the context of a buoy that is 56 m wide and 40 m long by way of example.

The invention has various advantages. It allows an entire BSR system to have better overall dynamic behaviour and in particular offers a significant increase in the fatigue life or endurance of the tether system. It also provides a better response to the 'one tether failure' extreme design case of a BSR system.

The riser support buoy of the invention is more robust and so can better accommodate a payload increase than prior designs. The structural design of the buoy is also more efficient as it places the tethers further away from main ballast tanks of the buoy. This means that fewer or smaller ballast tanks are required for the same payload, which results in lower structural and piping weight.

The orientation and length of the extended pontoon can be adjusted in the design stage to avoid any potential clash between a tether and a riser pipe or jumper pipe.

It should be understood that horizontally-projecting pontoons are known to be used in floating structures in the offshore oil and gas industry, but that these known uses are not relevant to the present invention. Such pontoons are conventionally used for anchoring tensioned leg platforms or 'TLPs', whichever type of mooring is used.

One reason for pontoons in the prior art is the need for space between mooring legs to accommodate a wellhead located directly under a TLP. Examples are shown in WO 97/29942 and U.S. Pat. No. 5,421,676. In WO 01/62583, the pontoons of a TLP have the additional benefit of allowing sufficient space to add additional buoyancy modules below the platform. Another form of TLP is disclosed in JP 2010234965 for supporting an offshore wind turbine.

U.S. Pat. No. 6,447,208 teaches that the buoyancy of buoyant pontoons or wings can add stability to a TLP but this teaches away from the problem and solution that define the present invention.

U.S. Pat. No. 7,854,570 discloses a TLP whose legs are attached to piles without pontoons, teaching that a TLP without pontoons has a smaller subsea projected area than a conventional TLP with pontoons. This reduces the TLP's response to ocean currents and wave action and shortens its natural period, enabling the TLP to be deployed in greater water depths than a TLP with pontoons. U.S. Pat. No. 7,854,570 therefore teaches away from the present invention by suggesting that pontoons should be omitted and in any event is not relevant because a BSR is situated below the effects of wave action.

In conclusion, and as can be deduced from U.S. Pat. No. 7,854,570, the way that pontoons are used in TLPs is not relevant to the technical challenges faced by BSR systems. For example, the main vertical structure of the TLP adds an additional turning moment that decreases stability. The TLP design also has to accommodate sea motion at and near to the surface, including the splash zone. This is mitigated in TLPs by using the structure of the pontoons to provide additional buoyancy.

In order that the invention may be more readily understood, reference will now be made, by way of example, to the accompanying drawings, in which:

FIG. 1 of the drawings does not show the invention as such but instead explains its context. The remaining drawings show embodiments of the invention with the exception of FIG. 7, which shows a riser support buoy known in the prior art. Like numerals are used for like parts where appropriate.

Figure 1:
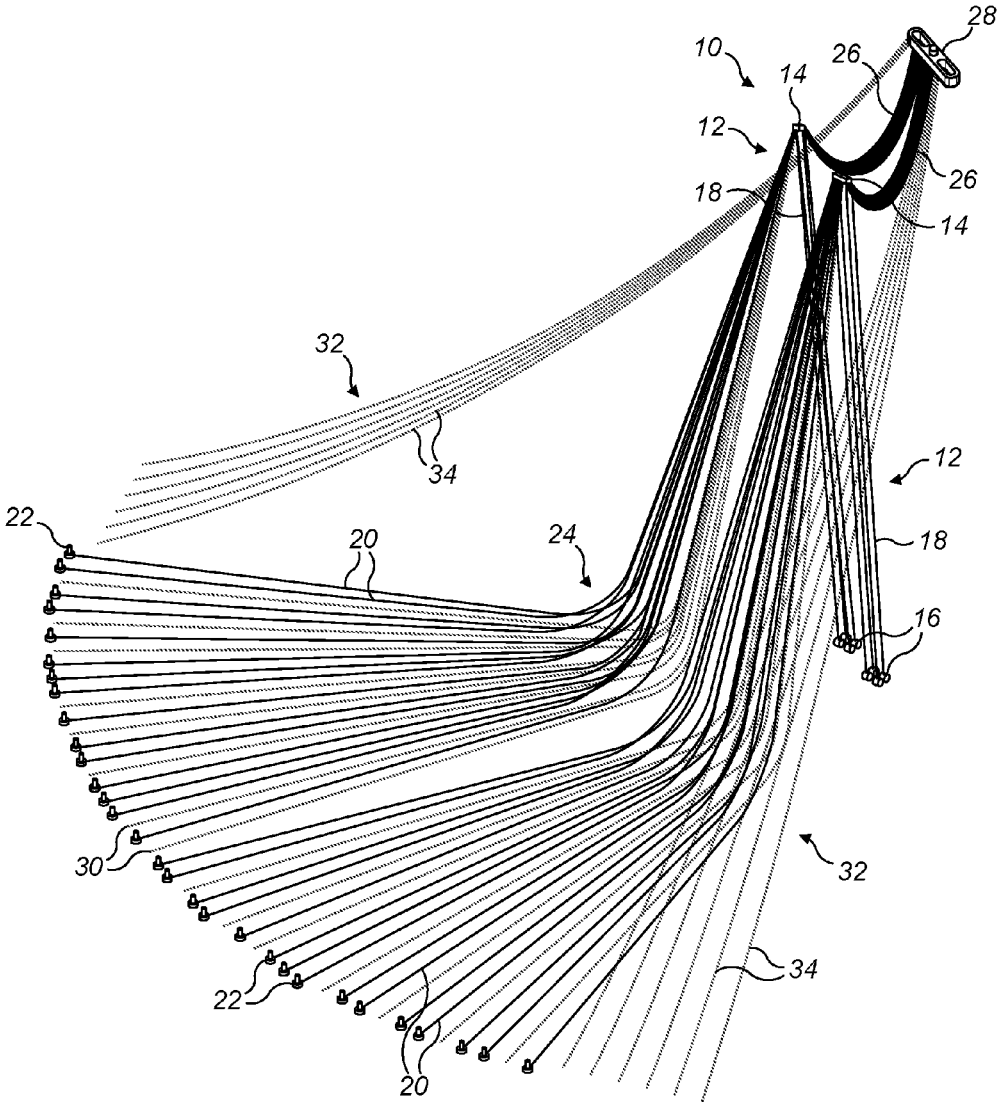
FIG. 1 is a perspective view of a riser installation to put the invention into context, the installation in this example comprising two BSR systems in conjunction with a single spread-moored FPSO.
Figure 2:
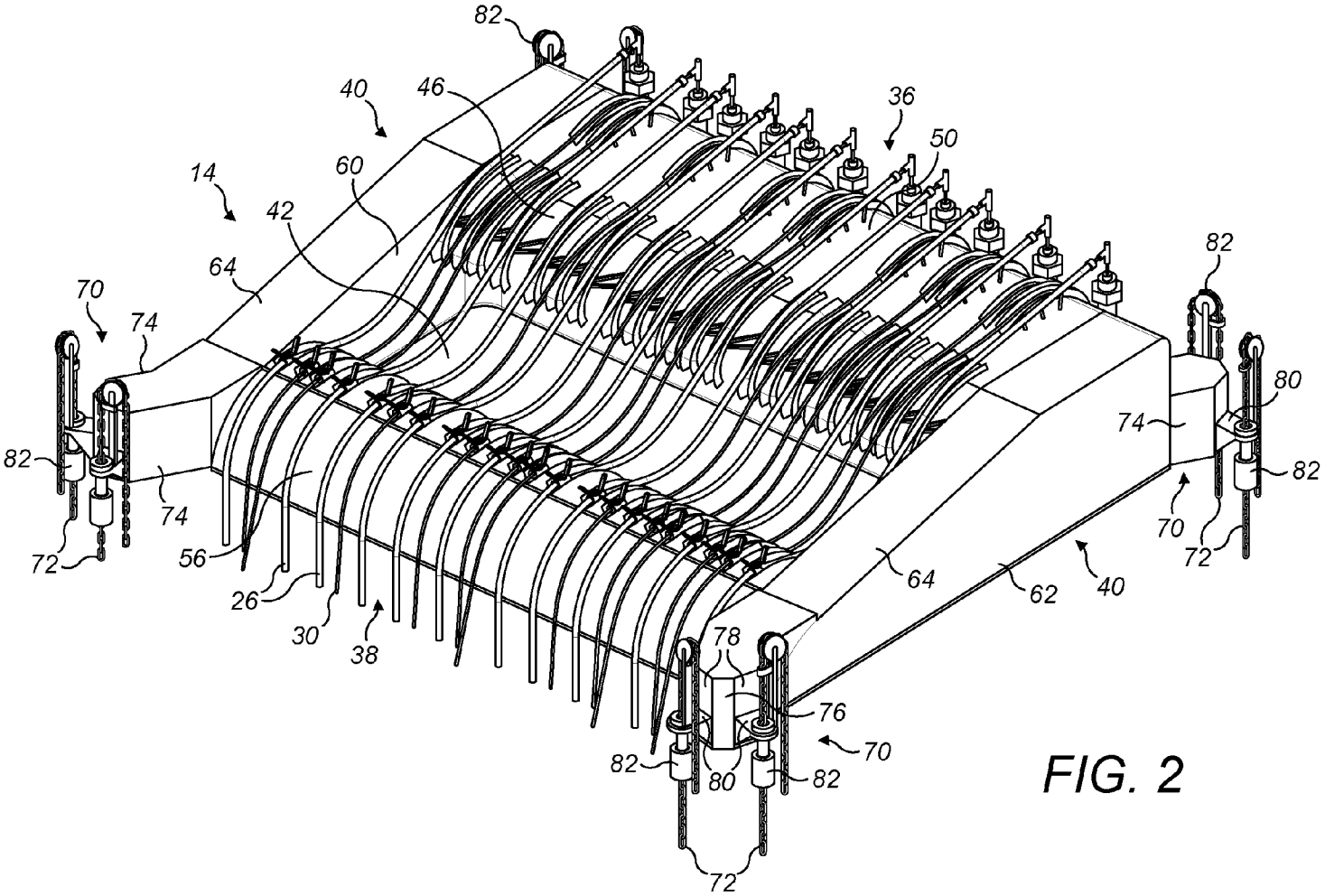
FIG. 2 is a perspective view of a riser support buoy in accordance with the invention.

Referring firstly then to FIG. 1 to appreciate the background of the invention, a BSR system 10 comprises two riser supports 12 in this example, although the number of riser supports 12 is immaterial to the inventive concept. Each riser support 12 comprises a riser support buoy 14, a seabed foundation 16 and a tether arrangement 18 extending between the foundation 16 and the buoy 14. Each tether arrangement 18 comprises eight tethers in four pairs in this example, maintained under tension by the buoyancy of the buoy 14.

Each buoy 14 supports a group of riser pipes 20 in the form of SCRs that each extend from respective PLETs 22 across the seabed, through a sag bend 24 and from there up to the buoy 14. The riser pipes 20 converge upwardly toward the buoy 14 and each group of riser pipes 20 fans out across the seabed to the PLETs 22.

Each riser pipe 20 communicates with a respective jumper pipe 26 that hangs as a catenary between the buoy 14 and an FPSO 28. The FPSO 28 is moored with its hull extending parallel to an axis containing both buoys 14, whereby the jumper pipes 26 connect amidships to one side of the FPSO 28.

As noted previously, umbilicals and other pipes 30 generally follow the paths of the riser pipes 20 and jumper pipes 26. These umbilicals 30 can be distinguished from the riser pipes 20 in FIG. 1 as they do not terminate in PLETs 22, and as they have a smaller bend radius at the sag bend 24.

The FPSO 28 shown in FIG. 1 is spread-moored with four sets 32 of six mooring lines 34. Again, the number of mooring lines 34 is immaterial to the inventive concept. Two of the sets 32 of mooring lines 34—one attached near each end of the FPSO 28—are shown in FIG. 1. It will be clear that the riser installation 10 is accommodated so closely between these neighbouring sets 32 of mooring lines 34 that it is challenging to avoid interference between the mooring lines 34 and the riser supports 12, the riser pipes 20 and the jumper pipes 26.

Referring next to FIGS. 2 to 6, a riser support buoy 14 in accordance with the invention is generally rectangular in plan view. The buoy 14 comprises four buoyant members that are generally straight beams in plan view—namely a riser support member 36, a jumper support member 38 and two side members 40—which together surround a rectangular central opening 42.

Each member 36, 38, 40 is hollow and is partitioned internally by bulkheads into compartments to define ballast tanks. The ballast tanks have adjustable buoyancy to aid installation of the buoy 14 and to keep the buoy 14 level in use, for example as successive riser pipes 20 are attached to the buoy 14.

The riser support member 36 and the jumper support member 38 extend along parallel horizontal axes, spaced apart from each other and joined by the side members 40. The side members 40 also extend along parallel horizontal axes, spaced apart from each other and extending orthogonally with respect to the riser support member 36 and the jumper support member 38. The central opening 42 is defined by the spaces between the members 36, 38, 40.

The members 36, 38, 40 have flat-bottomed cross-sections with bottom walls disposed in a common plane that is substantially horizontal when the buoy 14 is in use.

The riser support member 36 has a rectangular cross-section defined by generally flat walls, namely a bottom wall 44, an inner wall 46, an outer wall 48 and a top wall 50. Each wall 44, 46, 48, 50 is disposed orthogonally with respect to the adjoining walls of the cross-section. Thus, the bottom wall 44 and the top wall 50 are substantially horizontal and the inner wall 46 and the outer wall 48 are substantially vertical when the buoy 14 is oriented for use.

The jumper support member 38 has an approximately quarter-circular cross-section defined by a flat bottom wall 52, a flat inner wall 54 extending orthogonally from the bottom wall 52 and a top wall 56 that is convex-curved in cross-section. The top wall 56 curves smoothly between the top of the inner wall 54 and the outer edge of the bottom wall 52 to support the jumper pipes 26 and the umbilicals 30.

The side members 40 each have a rectangular cross-section defined by generally flat walls, namely a bottom wall 58, an inner wall 60, an outer wall 62 and a top wall 64. Each wall 58, 60, 62, 64 is disposed orthogonally with respect to the adjoining walls of the cross-section. Thus, the bottom wall 58 is substantially horizontal and the inner wall 46 and the outer wall 48 are substantially vertical when the buoy 14 is oriented for use. The top wall 64 is horizontal in cross-section but lies in an inclined plane as will be described.

The buoy 14 has a width defined as the horizontal distance between the outer walls 62 of the side members 40, measured parallel to the riser support member 36 and the jumper support member 38. The buoy 14 also has a length defined as the horizontal distance, measured parallel to the side members 40, between the outer wall 48 of the riser support member 36 and the outer edge of the bottom wall 52 of the jumper support member 38 at its intersection with the curved top wall 56.

In this non-limiting example, the width of the buoy 14 is 56 m and the length of the buoy is 40 m. It will therefore be apparent that the length of a buoy 14 may be less than its width. In this sense, the expression 'length' follows from the longitudinal direction in which fluids flow relative to the buoy 14 through the riser pipes 20 and the jumper pipes 26.

The riser support member 36 is much larger in cross-section than the jumper support member 38 so as to provide greater buoyancy to support the heavier riser pipes 20. To increase the cross-section of the riser support member 36 in this way without a corresponding increase in the length of the buoy 14, the top of the riser support member 36 is higher than the top of the jumper support member 38. As each side member 40 matches the height of the riser support member 36 at one end and the height of the jumper support member 38 at the opposite end, the top walls 64 of the side members 40 are inclined to reflect this difference in height. Consequently, the side members 40 are somewhat wedge-shaped in side view, tapering from the inner wall 46 of the riser support member 36 to the inner wall 54 of the jumper support member 38.

As is well known in the art, the riser support member 36 carries an array of connectors 66 for connecting the riser pipes 20 to the jumper pipes 26. Also, the riser support member 36 and the jumper support member 38 carry various guide structures 68 for supporting the jumper pipes 26 and the umbilicals 30. Thus supported, the jumper pipes 26 and the umbilicals 30 cross the top wall 50 of the riser support member 36, span the central opening 42 lengthwise and drape across the top wall 56 of the jumper support member 38. From here, the jumper pipes 26 and the umbilicals 30 begin their catenary curve to the surface.

In accordance with the invention, pontoons 70 protrude from each corner of the buoy 14 in plan view so that tethers, represented here by top chains 72, attach to the buoy 14 via the pontoons 70 at locations outboard of the riser support member 36 and the jumper support member 38, and preferably also outboard of the side members 40. In this embodiment, the pontoons 70 extend from the opposed ends of each side member 40, beyond the lengthwise extremities of the riser support member 36 and the jumper support member 38 where the buoy 14 is viewed from one side.

The pontoons 70 do not contribute buoyancy. The buoyancy of the pontoons 70 is constant, whether neutral or negative.

Figure 3:
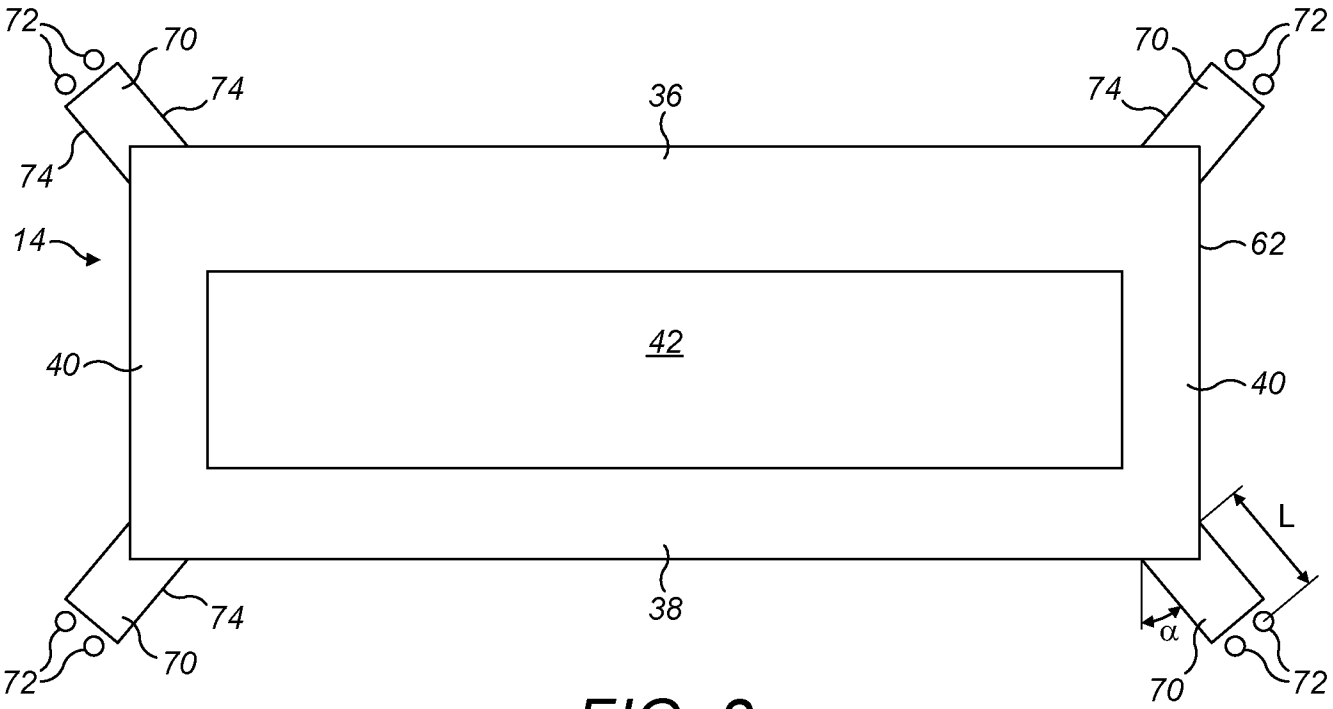
FIG. 3 is a schematic plan view of a riser support buoy in accordance with the invention.

The pontoons 70 also splay outwardly in plan view, each lying at an acute angle $\alpha$ to the longitudinal axis of the associated side member 40 as shown in FIG. 3, which angle is preferably between 20° and 45° and more preferably between 25° and 35°. The longitudinal axis of the side member 40 is parallel to the outer wall 62 of the side member 40 in this example, as shown schematically in FIG. 3. Consequently, in this embodiment, the pontoons 70 extend not only lengthwise beyond the riser support member 36 and the jumper support member 38 but also widthwise beyond the side members 40.

FIG. 3 also shows the length L of each pontoon 70 protruding from the side members 40 up to the attachment points for the top chains 72. In a typical buoy, by way of example, L may be between 3 m and 8 m and preferably between 4 m and 7 m.

In plan view, the pontoons 70 are narrower than the members 36, 38, 40 so as to minimise their effect on the apparent weight of the buoy 14. For this reason, the pontoons 70 at the riser end of the side members 40 are also substantially lower in side view than the riser support member 36, as will be appreciated in FIGS. 2 and 6 especially. The pontoons 70 need have no added buoyancy, although this is optional.

As noted previously, relocating the tethers to the extended pontoons 70 reduces the space between the tethers and the riser pipes 20 and jumper pipes 26. A complete series of in-place and installation analyses must be performed to determine the length L and the angle $\alpha$ of the pontoons 70 relative to the side members 40 for every intended system to which this solution will be applied in order to avoid any potential clashes.

Each pontoon 70 has parallel vertical side walls 74 and terminates in a chamfered, faceted vertical end wall comprising a central facet 76 that is orthogonal to the side walls 74. The central facet 76 lies between outer facets 78 that, in plan view, lie at 45° to the central facet 76 in opposed directions and so lie orthogonally with respect to each other.

Cantilevered hang-off porches 80 extend outwardly like shelves from the outer facets 78. The hang-off porches 80 support respective top connectors 82 that are engaged with the top chains 72 to set and maintain tension in the associated tethers.

The protruding length of each pontoon 70 along its longitudinal axis is typically between 3 m and 8 m and preferably between 4 m and 7 m. In this example, including the hang-off porches 80, the pontoons 70 increase the overall length of the buoy 14 from 56 m to 64.2 m and the overall width of the buoy 14 from 40 m to 56 m.

Figure 4:
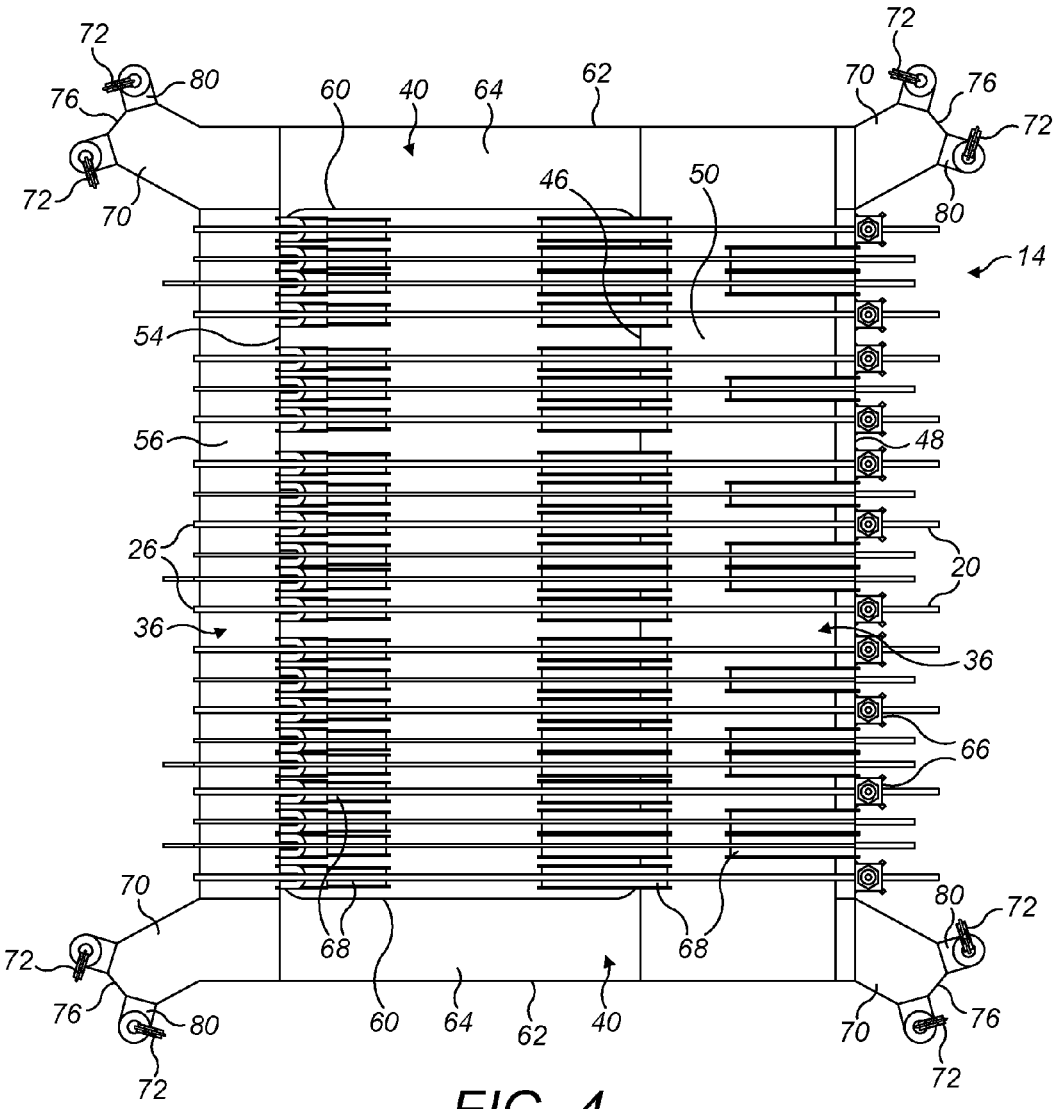
FIG. 4 is a plan view of the riser support buoy shown in FIG. 2.
Figure 5:
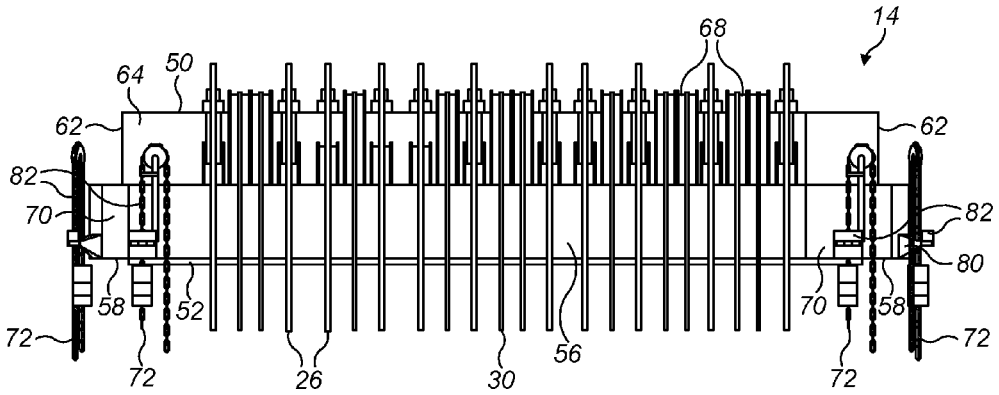
FIG. 5 is an end view of the riser support buoy shown in FIG. 2, viewed from a jumper end of the buoy.
Figure 6:
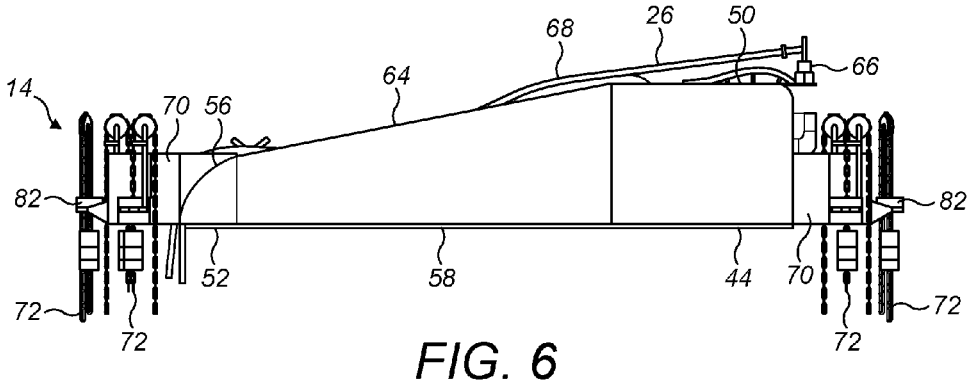
FIG. 6 is a side view of the riser support buoy shown in FIG. 2.

It will be evident from the plan view of FIG. 4 that the eight tethers all attach to the buoy 14 outside the lengthwise extremities of the riser support member 36 and the jumper support member 38, far outside the centres of buoyancy of those members 36, 38. Also, four of the tethers attach to the buoy 14 outside the widthwise extremities of the side members 36, again far outside the centres of buoyancy of those members 40. It will also be evident how each pontoon 70 extends beyond the underlying rectangular shape of the buoy 14 defined by the members 36, 38, 40.

Figure 7:
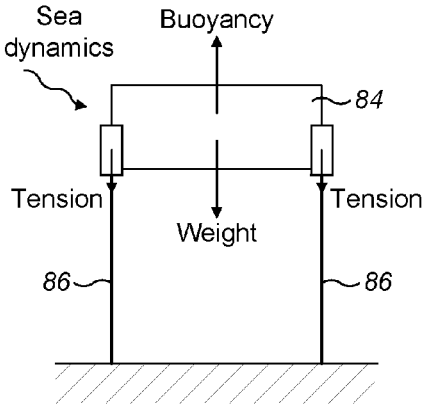
FIG. 7 Prior Art
FIG. 7 is a schematic side view showing the forces that act on a riser support buoy known in the prior art.
Figure 8:
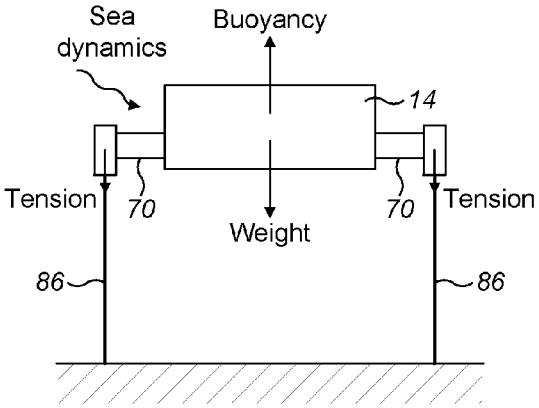
FIG. 8 is a schematic side view corresponding to FIG. 7 but showing the forces that act on a riser support buoy in accordance with the invention.

Moving on to FIGS. 7 and 8, these compare a prior art riser support buoy 84 shown schematically in FIG. 7 and the buoy 14 of the invention shown schematically in FIG. 8. Forces acting on the respective buoys 14, 84 are apparent, as is the notably-increased gap between tethers 86 in the lengthwise direction in FIG. 8 by virtue of the pontoons 70, which gap acts especially to resist pitch of the buoy 14.

Figure 9:
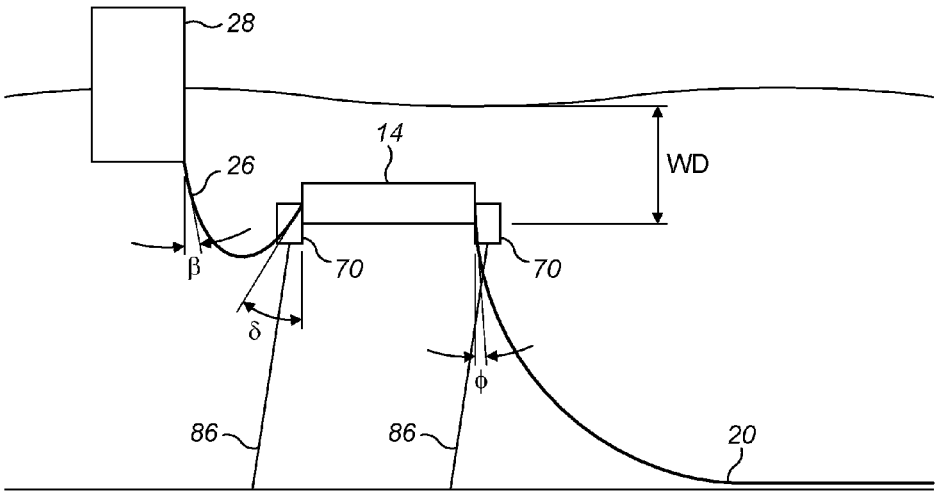
FIG. 9 is a schematic side view of a BSR system including a riser support buoy in accordance with the invention.

Turning finally to FIG. 9, this shows schematically how the solution of the invention employing extended pontoons 70 also requires proper positioning of the riser support buoy 14 in the field, allowing proper mass and buoyancy balancing of the entire system and adjusting the tension in the tethers 86. Correct positioning of the buoy 14 is mainly defined by setting proper azimuth angles for the jumper pipes 26 ($\beta$ and $\delta$) and for the riser pipes 20 ($\phi$) and also by positioning the buoy 14 in a water depth WD that eliminates a risk of clashing between the tethers 86 and the riser pipes 20 and jumper pipes 26.

In conclusion, if extended pontoons were not used, larger and heavier tethers or a greater number of tethers would have to be used to achieve similar pitch behaviour and fatigue endurance for the same main hull dimensions of the buoy and the same motions of the FPSO. Increasing the number and size of tethers in this way would significantly increase the installation complexity and cost of a project using a BSR system.

The extended pontoons concept of the invention confers much better dynamic behaviour on a BSR system and improves the responses of the system in extreme and tether-failure cases with reduced buoy motion and increased fatigue life for tethers, riser pipes and jumper pipes. So, for given main hull dimensions of the buoy and for a given tether system, the extended pontoons concept advantageously limits the pitch period of the buoy and minimises fluctuating loads on the tethers, increasing their endurance.

The invention claimed is:

1. A subsea riser support buoy comprising:

a positively buoyant riser support member and a positively buoyant jumper support member that extend generally parallel to each other and that define a lengthwise direction extending between them across the buoy, the riser support member and the jumper support member being spaced apart from each other in the lengthwise direction;

side members that extend in the lengthwise direction at ends of the riser support member and the jumper support member to join the riser support member and the jumper support member; and pontoons of negative or neutral buoyancy that extend lengthwise from opposed ends of each side member and beyond the positive buoyancy of the riser support member and the jumper support member, the pontoons comprising attachment points for connecting tethers to the buoy.

2. The buoy of claim 1, wherein the side members are positively buoyant and the pontoons extend lengthwise beyond the positive buoyancy of the side members.

3. The buoy of claim 1, wherein the pontoons also extend in a widthwise direction beyond the side members.

4. The buoy of claim 1, wherein the pontoons extend the overall width of the buoy by 5% to 20% up to the attachment points relative to the width of the buoy across the side members.

5. The buoy of claim 1, wherein each pontoon has a longitudinal axis that lies at an angle $\alpha$ to a lengthwise axis of a side member, where $\alpha$ is in the range 20° to 45°.

6. The buoy of claim 1, wherein the pontoons extend the overall length of the buoy by 20% to 50% up to the attachment points relative to the length of the buoy across the riser support member and the jumper support member.

7. A seabed-to-surface riser system comprising a subsea riser support buoy and tethers connected to the attachment points of the buoy and extending toward the seabed, the riser support buoy comprising:

a positively buoyant riser support member and a positively buoyant jumper support member that extend generally parallel to each other and that define a lengthwise direction extending between them across the buoy, the riser support member and the jumper support member being spaced apart from each other in the lengthwise direction;

side members that extend in the lengthwise direction at ends of the riser support member and the jumper support member to join the riser support member and the jumper support member; and pontoons of negative or neutral buoyancy that extend lengthwise from opposed ends of each side member and beyond the positive buoyancy of the riser support member and the jumper support member, the pontoons comprising attachment points for connecting tethers to the buoy.

8. The seabed-to-surface riser system of claim 7, wherein the side members are positively buoyant and the pontoons extend lengthwise beyond the positive buoyancy of the side members.

9. The seabed-to-surface riser system of claim 7, wherein the pontoons also extend in a widthwise direction beyond the side members.

10. The seabed-to-surface riser system of claim 7, wherein the pontoons extend the overall width of the buoy by 5% to 20% up to the attachment points relative to the width of the buoy across the side members.

11. The seabed-to-surface riser system of claim 7, wherein each pontoon has a longitudinal axis that lies at an angle a to a lengthwise axis of a side member, where $\alpha$ is in the range 20° to 45°.

12. The seabed-to-surface riser system of claim 7, wherein the pontoons extend the overall length of the buoy by 20% to 50% up to the attachment points relative to the length of the buoy across the riser support member and the jumper support member.

13. A method of altering the dynamic behavior of a subsea riser support buoy that comprises a positively-buoyant riser support member and a positively-buoyant jumper support member defining a lengthwise direction extending between them across the buoy, the riser support member and the jumper support member being spaced apart from each other in the lengthwise direction, and further comprising side members that extend in the lengthwise direction at ends of the riser support member and the jumper support member to join the riser support member and the jumper support member, the method comprising providing pontoons of negative or neutral buoyancy that extend lengthwise from opposed ends of each side member to space tether attachment points further apart lengthwise than the positive buoyancy of the riser support member and the jumper support member.

* * * * *